United States Patent [19]

Genuit

[11] Patent Number: 4,631,962

[45] Date of Patent: Dec. 30, 1986

[54] ARTIFICIAL HEAD MEASURING SYSTEM

[75] Inventor: Klaus Genuit, Aachen, Fed. Rep. of Germany

[73] Assignee: Head Stereo GmbH, Kopfbezogene Aufnahmeund, Munich, Fed. Rep. of Germany

[21] Appl. No.: 715,878

[22] Filed: Mar. 25, 1985

[30] Foreign Application Priority Data

Mar. 27, 1984 [DE] Fed. Rep. of Germany ..... 3411236
Mar. 15, 1985 [DE] Fed. Rep. of Germany ..... 3509376

[51] Int. Cl.[4] ..... H04S 1/00

[52] U.S. Cl. ..... 73/585; 434/270; 73/1 DV; 73/866.4

[58] Field of Search ..... 73/585, 1 DV, 432 SD, 73/432 J; 434/270, 271

[56] References Cited

U.S. PATENT DOCUMENTS 1,868,209 7/1932 Kapernick ..... 434/271
4,209,919 7/1980 Kirikae et al. ..... 434/270

FOREIGN PATENT DOCUMENTS 3146706 6/1983 Fed. Rep. of Germany .

*Primary Examiner*—Stephen A. Kreitman
*Attorney, Agent, or Firm*—McAulay, Fields, Fisher, Goldstein & Nissen

[57] ABSTRACT

An artificial head acoustic measuring system includes a construction including portions configured to appear as human shoulders, head and ears on both sides of the head with auditory canals and microphones disposed in the auditory canals. The head portion comprises partial bodies corresponding to mean data of test persons with respect to dimensions and relative positions. The partial bodies comprise regular geometric bodies calibrated with respect to sound reflexion, diffraction and resonance behavior to define a reproducible artificial-head transmission function related to the outer geometric configuration of the construction.

8 Claims, 10 Drawing Figures

ARTIFICIAL HEAD MEASURING SYSTEM

BACKGROUND OF THE INVENTION

The invention relates to an artificial-head measuring system of the species described in the main claim. It has been previously known in a wide-band, low-noise artificial head of a great dynamic range (German Patent Document No. 31 46 706) to combine accurate reproductions of the acoustically essential geometrical structures of the head, auricles and shoulders of an electroacoustical sound recording system (artificial head) with special acoustical, electroacoustical and electronic means so that optimum high-fidelity acoustical transmission is achieved. The essential means by which this purpose is to be achieved in the known artificial head consist in that the acoustically essential geometrical dimensions are reproduced on the imitated head and also on the imitated auricles, via dimensionally accurate impressions in plastic material, to reflect truly the corresponding dimensions of selected living persons for which purpose especially the imitated head is to provide a dimensionally true reproduction of the head of a test person whose head has dimensions closely approximating the average. Accordingly, such a known artificial head permits high-fidelity transmission of aural phenomena, but is problematic insofar as no complete calibration of the system can be reached, and this exactly because of the attempt to imitate the head as accurately as possible. This means, however, in other words that the outer-ear transmission function of the respective artificial head must be established every time anew by corresponding measurements and that, accordingly, one cannot simply draw conclusions from the measured signals as to the nature and characteristic of the acoustical phenomenon acting on the artificial head as measuring system—a fact which is of considerable importance for acoustical measuring techniques. However, measuring results must be reproducible, just as as the measuring system used for measuring. Therefore, the present invention has for its object to provide an artificial-head measuring system which in spite of the extremely complex total structure apparent to the man of the art and comprising for example reproductions of the head, the neck, shoulders and the auricles, is still capable of being calibrated.

ADVANTAGES OF THE INVENTION

The present invention achieves this object by the characterizing features of the main claim and offers the advantage to provide an artificial head for use as measuring system for acoustical phenomena which is effective throughout the full aural range and fully calibratable and which being reduced to simple bodies or partial bodies which are calculable at least for the man of the art as regards their acoustic behavior (reflexion, diffraction, ear resonance, and the like) lends itself as a whole for reproduction of the artificial-head microphone signals via a free-field equalized headset, without any restriction of the directional reproduction, due to its exactly defined simplified outer geometry. Accordingly, such a fully calibratable artificial-head measuring system can be used with particular advantage as a useful measuring, control and monitoring instrument in acoustic measuring techniques and also as a studio microphone for language and music in the broadcasting field.

The following are three applications of the fully calibratable artificial-head measuring system of the invention:

1. The artificial-head measuring system may be used as reference test person in psychoacoustics since, contrary to a living test person with inserted sensor microphones, it forms a so-called LTI system* with transmission characteristics which remain unchanged and capable of being verified under all test conditions.

linear time invariant system

2. The artificial-head measuring system of the invention can be used as measuring microphone in acoustic measuring techniques (for example for measurements on headsets and ear muffs) and in noise diagnosis. Previous measuring methods used for example microphones with spherical directional characteristic for determining the A-weighed sound level. The human outer ear has, however, a completely different directional characteristic. Measurements that do not give consideration to this subjective directional characteristic of the human outer ear cannot be generalized and do not really meet the objective of the measuring process. By using the artificial head of the invention as a measuring microphone one now has the possibility to store sounds by means of a recording unit and to procede to a subjective assessment of sounds or noise-reducing measures—it being understood that the term subjective as used herein refers to the specificity to the "receiver" constituted by the "human sense of hearing". Such a subjective measuring process will then as a rule very quickly lead to a clear judgement because the human sense of hearing evaluates a larger number of parameters of an offered acoustical phenomenon than is evaluated by "objective" measuring techniques. So, it has been known for example from practical experience that a sound of a higher A-weighed level may under certain circumstances be classified as less troublesome.

3. The calibratable artificial-head measuring system of the invention may be used as studio microphone in the sound engineering field. An acoustical phenomenon is composed as a rule of the sound components originating directly from the location of the sound source, and the time-delayed reflexions arriving from different directions. In conventional recording methods, either only the direct sound components are recorded, or the reflexions are not weighed using a directional characteristic equivalent to the outer ear. This problem is solved by the invention in a decisive and, above all, due to its calibrating capabilities, generally applicable way.

Investigations and measurements carried out on the artificial-head measuring system of the invention have shown that the directional characteristic of the latter corresponds to the mean directional characteristic of man, that no background noise is audible so that hearing tests are rendered possible also in the area of the threshold of hearing, and that the dynamic range corresponds to the human sense of hearing up to the threshold of pain so that even level peaks can be recorded undistorted (jingling keys or clapping hands produce for example, at a distance of 1 m from the ear, sound level peaks in the range of approx. 135 dB of a duration of approx. 0.05 ms).

By reducing the outer geometry of the artificial-head measuring system of the invention to the acoustically relevant geometry, in accordance with an essential partial step of the invention, the outer ear transmission functions which heretofore were not calculable mathematically (not calculable because of their complex outer bordering formed by the auricle and head, and the complex inner structure of the auricle, and the like, which necessarily precludes exact calibration) can now be described mathematically and in terms of measuring techniques, i.e. recorded and pre-determined, and it can now be shown that the outer ear transmission function realized by the artificial-head measuring system corresponds to that subjectively present in really existing test persons either identically or with only minor variations so that for the technical purposes of the present invention they can be regarded as practically identical. Accordingly, the invention provides by its geometrical structure an artificial-head measuring system capable of being calibrated, this approach being based on the realization that it can be shown that one does not have to solve the exact diffraction integrals normally necessary for calculating the transmission function, but that by reducing the system to calibratable, calculable bodies such as spheres, cylinders, cylinders with bores, ellipses, and the like, a reproducible total system can be provided which, being calibratable in its parts, is also calibratable in its entirety.

Further improvements of the invention are described and specified in the sub-claims.

BRIEF DESCRIPTION OF THE DRAWING

One embodiment of the invention is shown in the drawing and will be described in detail in the ensuing specification. In the drawing.

DESCRIPTION OF THE EMBODIMENTS

The basic concept of the present invention consists in making the entire artificial-head measuring system capable of being calibrated by reducing the outer describable geometry, in terms of the geometrical structure determining the directional characteristic of the system, to the acoustically relevant geometry as determined by calculations and measurements, and, in consequence thereof, in building up the artificial-head measuring system from individual partial bodies which have predetermined dimensions and pre-determined positions relative to each other and which as such can be derived from geometrically simple bodies such as cylinder, ellipse, cuboid or sphere and can, therefore, be calculated mathematically.

Another information seems to be necessary at this point. Contrary to usual patent practice, where dimensions and/or dimensional data are rather of minor importance, with some exceptions, such dimensional data are absolutely relevant in the case of the present artificial-head measuring system for the realization of the invention, provided they are understood as lying within pre-determined dispersion limits, because the outer ear transmission functions of the artificial head, the directional characteristic, and the like, are determined in a decisive manner not only by the dimensions, but also by the relative position of the individual partial bodies, for example and in particular the nature of approximation and the position of the auricles.

Figure 1:
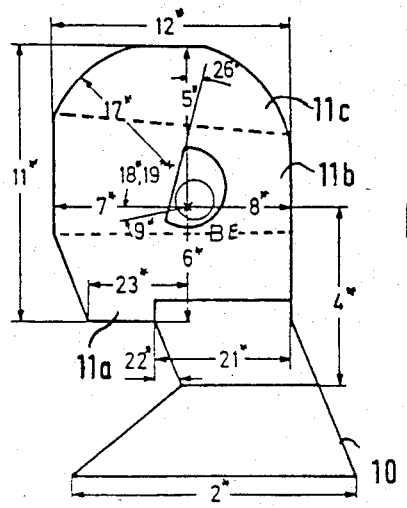
FIG. 1 is a side view.
Figure 2:
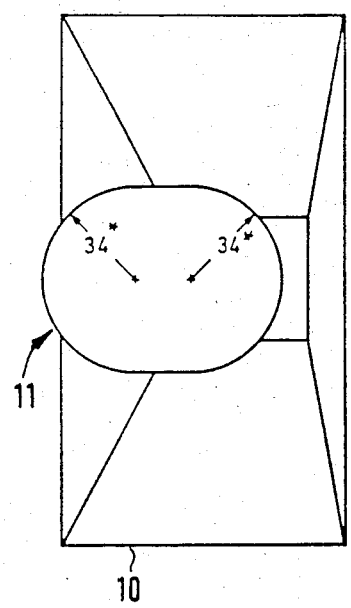
FIG. 2 is a top view.
Figure 3:
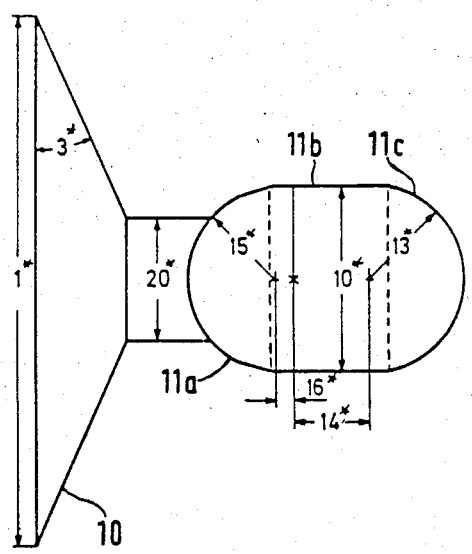
FIG. 3 is a front view of the artificial-head measuring system according to the invention.
Figure 4A:
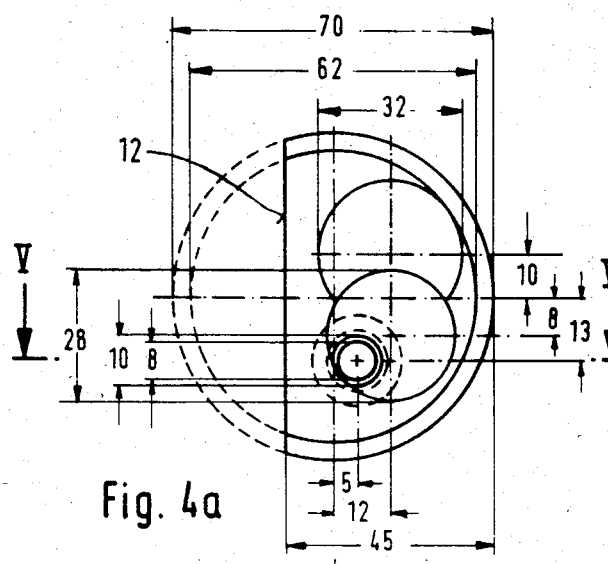
FIG. 4*a* is a top view of the first embodiment of an imitated auricle, in an enlarged representation relative to the first-mentioned figures.
Figure 4B:
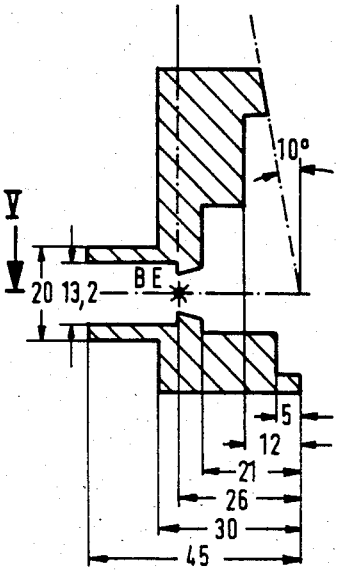
FIG. 4*b* shows a cross-section through the imitated auricle of FIG. 4*a* in which the full shape of the individual cavities can be seen.
Figure 5:
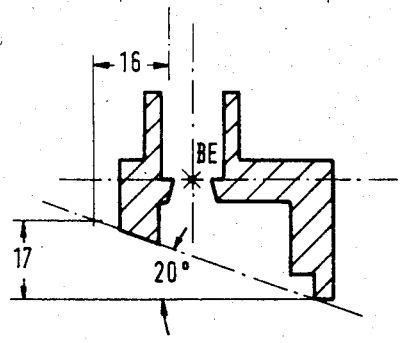
FIG. 5 shows a longitudinal cross-section through the imitated auricle of FIG. 4*a*, taken along line V/V.

This is the reason why FIGS. 4*a*, 4*b* and FIG. 5, for example, contain effective measurements in millimeters; FIGS. 1, 2 and 3 contain numbers identified by an asterisk which can be related to specific sizes, dimensions and dimensional data, angles and the like using a table given further below.

Investigations carried out on basically complex mathematical representations and terms (diffraction integrals, and the like) and on simplifications of these terms made for the purpose of a technically meaningful realization, have shown that the acoustically effective geometry of a fully calibratable artificial-head measuring system can be reduced, according to the representations shown in FIGS. 1, 2 and 3, to the following parameters, namely upper part of the body and shoulder 10 which determine substantially the directional characteristic in the median plane, secondly the head 11, whose diffracted waves and reflexions determine decisively the directional characteristic in the horizontal plane, and thirdly the shape and nature of the auricle, and its position and location on the head, whose influence makes itself felt in the horizontal and in particular the median planes (cavum conchae bordering). The head 11 has no significant influence on the outer ear transmission function in the median plane, the acoustic effectiveness of the shoulder is limited substantially to the frequency range below 2000 Hz.

In the artificial-head measuring system according to the invention, the upper body 10 does not only fulfill the function of a diffraction body, but serves conveniently also as a receptacle for the necessary electronic components and a recording unit so that the system can be operated absolutely independent of other equipment. The width and depth of the upper part of the body 10 correspond with the dimensions of the shoulder; as the upper part of the body is to imitate a seated test person, the depth increases downwardly to, say, 450 mm. so that the front deviates from the vertical by an angle of approximately 20°, at a height of 450 mm. For further dimensional data not mentioned specifically in the text, please refer to the following table where the reference numerals identified by an asterisk are associated with a description of the parameter concerned, a mean value of a particularly suitable measure, and further a dispersion value. All dimensions identified by such numerals with asterisks have been determined by forming the mean value from seven geometrically measured (male) test persons.

TABLE (Reference plane BE = center of auditory canal)

| Ref. | Parameter | Mean value/ cm | Dispersion/ cm |
|---|---|---|---|
| 1* | Width of shoulders | 49.6 | 2.8 |
| 2* | Depth of shoulders | 26.9 | 2.9 |
| 3* | Slope of shoulders | 23.3 | 2.9 degrees |
| 4* | Distance reference plane/ shoulder | 16.0 | 1.1 |
| 5* | Distance reference plane/ top | 15.6 | 1.1 |
| 6* | Distance reference plane/ bottom | 10.5 | 0.5 |
| 7* | Distance reference plane/ front | 11.6 | 0.6 |
| 8* | Distance reference plane/ rear | 10.2 | 0.5 |
| 9* | Reference plane angle | 11.9 | 4.6 degrees |
| 10* | Width of head | 17.7 | 1.5 |
| 11* | Height of head | 26.1 | 1.0 |
| 12* | Depth of head | 21.7 | 0.6 |
| 13* | Head radius, top | 8.6 | 0.9 |
| 14* | Distance center above reference plane | 7.0 | 1.1 |
| 15* | Head radius, bottom | 6.6 | 1.3 |
| 16* | Distance center above reference plane | 2.5 | 0.7 |
| 17* | Lateral head radius | 11.9 | 0.7 |
| 18* | Distance center above reference plane | 4.1 | 1.3 |
| 19* | Lateral distance of center from reference plane | 1.4 | 1.0 |
| 20* | Width of neck | 10.4 | 0.8 |
| 21* | Depth of neck | 11.7 | 1.0 |
| 22* | Neck angle | 35.9 | 3.1 degrees |
| 23* | Distance chin/reference plane | 9.4 | 0.5 |
| 24* | Auricle height | 7.0 | 0.6 |
| 25* | Auricle width | 3.5 | 0.3 |
| 26* | Auricle slope | 12.4 | 5.3 degrees |
| 27* | Distance center above reference plane | 1.3 | 0.2 |
| 28* | Lateral distance of center from reference plane | 0.5 | 0.1 |
| 29* | Cavum conchae, height | 3.0 | 0.2 |
| 30* | Cavum conchae, width | 2.1 | 0.1 |
| 31* | Cavum conchae, depth | 1.9 | 1.7 |
| 32* | Distance center above reference plane | 0.4 | 0.1 |
| 33* | Lateral distance of center from reference plane | 0.8 | 0.1 |
| 34* | Head radius, top | 7.1 | 1.1 |

As can be seen best in FIG. 1, the bent-off front of the upper part of the body is to be regarded as the latter's most important part which influences the outer ear transmission function in the lower region of the spectrum in response to the direction. However, the dimensions of the upper part of the body need not be considered exactly because this partial body whose geometrical form represents a flattened pyramid, has an acoustical influence on the outer ear transmission properties only with respect to great wave lengths (0.25 m–1.5 m). The directional characteristic of the upper part of the body and the shoulders are determined substantially by the front and the lateral inclined surfaces, as well as the distance in height of the reference plane from the shoulder.

The imitated head 11 has the shape of an ellipsoid, as appears from the representations of FIGS. 2 and 3. To avoid technical difficulties, it is assembled during production from three partial bodies, namely a lower half 11*a* corresponding to a cylinder cut off in the longitudinal direction, a middle portion 11*b* corresponding to an oval disk, and an upper portion 11*c* composed of quarters of a sphere at the front and the rear, with half of a circular disk arranged therebetween. The imitated neck brings the height of the head to the mean distance 4* between the reference plane BE and the shoulder.

Even the complex shape of the auricle can be reduced to a simplified form, for example as shown in FIGS. 4*a*, 4*b* and 5. The essential parts comprise the outer and inner borderings of the auricle, whose diffraction properties determine the directional characteristic, and the cavities—substituting the cavum conchae—acting as acoustical resonance amplifiers contribute towards improving the signal-to-noise ratio of the microphone. The dimensions of the imitated auricle have also been determined by taking the arithmetic mean of the geometrical dimensions of seven test persons. As mentioned before, certain dimensions in mm have been entered directly in the figures showing the auricle.

Figure 10:
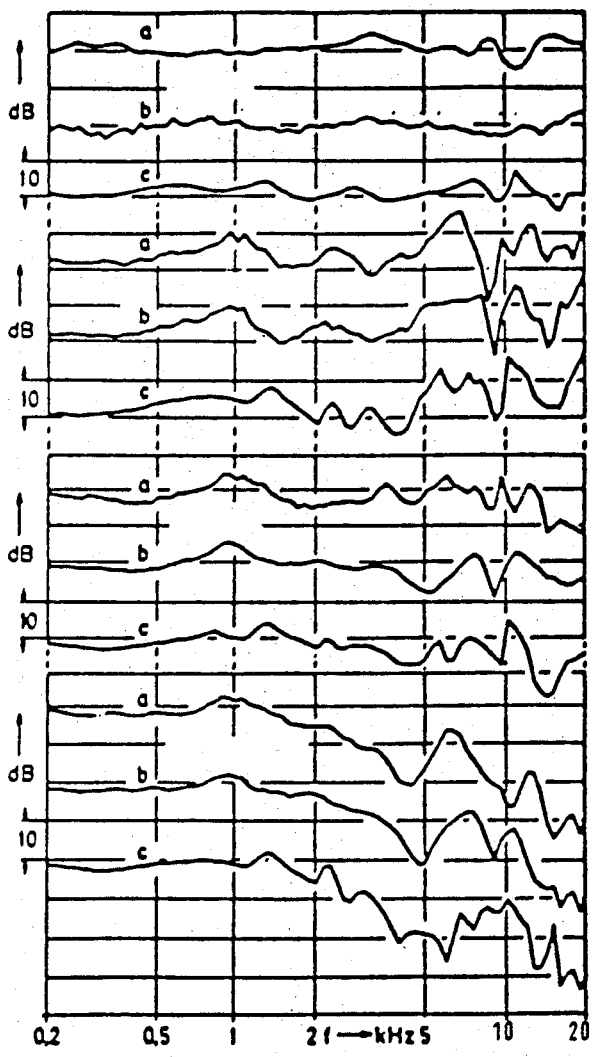
FIG. 10 shows a diagram curves consisting of curves relating to the directional characteristic of the artificial-head measuring system for different directions of sound incidence, compared with an artificial-head measuring system with exact imitation of the head and auricles, and a mean test person.

The imitated auricle is made from a cylinder (approx. 70 mm dia.), the cavum conchae being realized either by a single ovally shaped recess in the cylinder having, for example, a width of 21 mm, a height of 30 mm and a depth of 19 mm, with an imitated auditory canal orifice formed by an 8 mm dia. bore (not shown in the drawing); or else the ear can be imitated in the manner shown in FIGS. 4*a*, 4*b* and 5 with a plurality of communicating bores and recesses having the dimensions shown in the said figures. The final imitation of the auricle is then obtained by a longitudinal cut 12 through the cylinder, offset by about 10 mm from the center, the cut-off parts of the cylinder being discarded, and a slope of 20° in the imitated auricle of FIG. 5 and 10° in the imitated auricle of FIG. 4*b* (turned by 90°). The imitation of the other ear is mirror-symmetrical to that just described. The reference plane BE corresponds with the microphone plane. Additionally, a reference point BP can be defined at the center of the auricle orifice on the reference plane BE.

Further, it is an essential aspect of the present invention that all parts of the artificial head are free from undercuts, which means that no projecting parts are formed in cavities by inner enlargements thereof.

Besides, it has been found that the exact position (and location) of the imitated auricle is of essential importance for the attainment of identical directional characteristics and/or for the realization of the outer ear transmission functions. This means in other words that the distances and dimensions identified in FIG. 1 by 5*, 8*, 6* and 7* are of particular importance.

Considering that the artificial-head measuring system has been conceived also and in particular for use in measuring techniques, it is necessary in order to permit comprehensive calibration, that microphones be arranged for coupling to the auditory canal orifices which microphones must meet the requirement of low background noise in a suitable manner and have in addition a certain admissible maximum sound pressure level.

It has been found that the ½ inch microphone measuring inserts made by Messrs. Brüel+Kjaer and offered under the designation B+K 4166, are particularly suited for this use; the optimum length of the auditory canal has been calculated to correspond to a distance of 4 mm. The position of the microphone plane corresponds to the reference plane BE in measurements on test persons.

Figure 6:
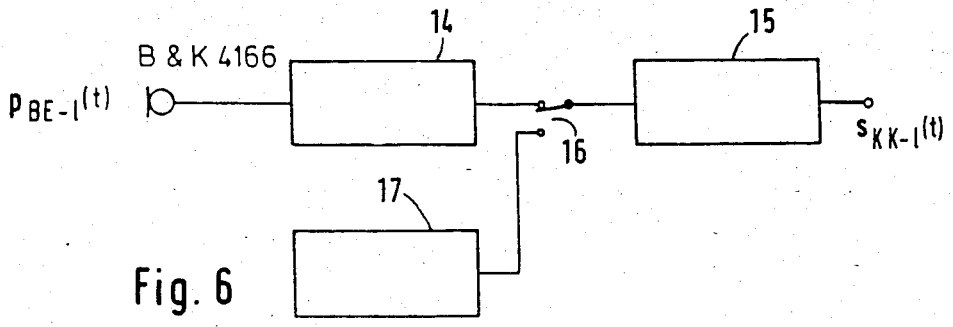
FIG. 6 shows the (single-channel) block diagram of the artificial-head measuring system.

FIG. 6 shows the electric components provided for further processing of the recorded sound pressures. The microphone signals are supplied via an impedance transformer 14 to a special anti-distortion circuit 15, there being provided means 16 for changing over to a test tone generator 17 with the aid of which a microphone voltage equivalent to a sound pressure of 94 dB, for a given frequency of, for example, f=240 Hz, can be produced so that the measuring and recording equipment connected downstream thereof can be calibrated.

The non-distortion circuit of the artificial-head measuring system according to the invention acts in such a manner that in the case of incidence of sound from the front in the free field, a linear frequency-independent transmission ratio can be measured at the artificial head output (so-called free-field equalization). The value of the transmission function of the non-distortion circuit is then inversely proportional to the free-field transmission function of the artificial head represented in FIG. 7, where the full-line curve relates to an artificial head with exact imitation of the outer geometry, while the curve shown in dotted lines relates to the fully calibratable artificial-head measuring system of the invention using a simplified mean geometry.

Figure 7:
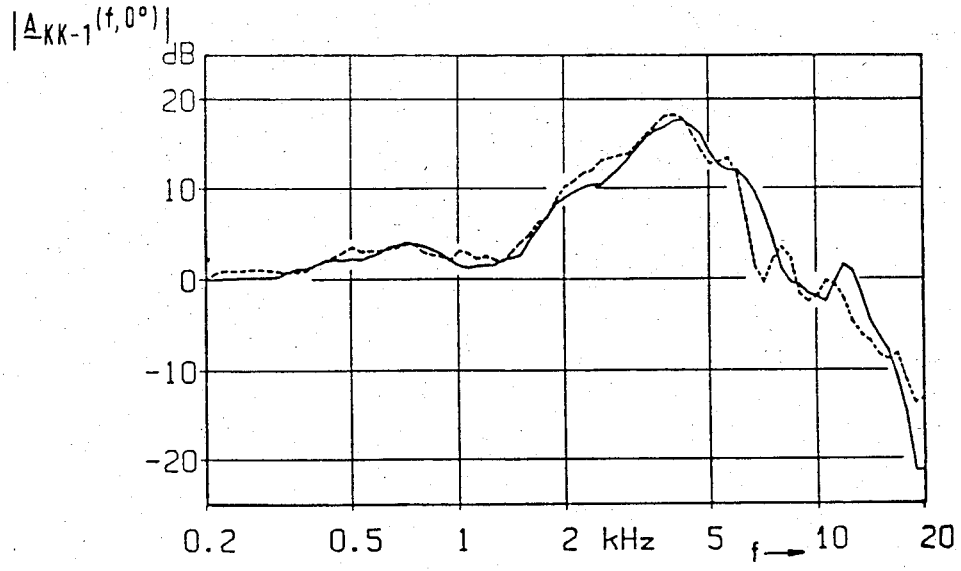
FIG. 7 shows the free-field transmission function for sound incident from the front, in the form of two curves, one for the artificial-head measuring system according to the invention with a simplified average geometry, and another one for an artificial head with accurate imitation of the outer (human) geometry.

It appears already from a comparison of the free-field transmission functions of the artificial heads represented in FIG. 7, that the use of the simplified mean geometry in an artificial-head measuring system permits on the one hand to make the latter perfectly calibratable and, on the other hand, to work with only an extremely small error which is practically negligible for the purposes of measuring techniques. Accordingly, the invention succeeds in a very efficient manner and for the first time in the field of artificial-head technology in developing a system which due to its comprehensive calibration capabilities lends itself to worldwide standardization. For the better understanding of this aspect, a possible example will be described briefly hereafter.

For example, in the field of motor vehicles, the comparative noise developed by passenger cars as perceived by the driver is of considerable practical importance—but up till now, direct comparisons by mere sound level measurements have been impossible because, as indicated already above, motor vehicles having low sound levels may be perceived (subjectively) as causing much more noise than vehicles having high sound levels; in addition, the direct comparison between individual vehicle types is practically impossible because of the different measuring methods and artificial-head systems used, if any. As compared to this state of the prior art, the invention permits to demonstrate, via headsets, the noises actually produced by motor vehicles, and this for example even at places remote from the vehicle itself, thus permitting direct comparisons. Further, it is also possible to compare noises recorded at completely different places on different vehicles directly with other recorded noises or direct measurements, provided the calibratable artificial head according to the invention is used which provides the possibility to draw direct conclusions from the measured signals as to the sound effects and noises actually developed, related to the outer ear transmission function with a directional characteristic for sound incidence from the front.

Figure 8:
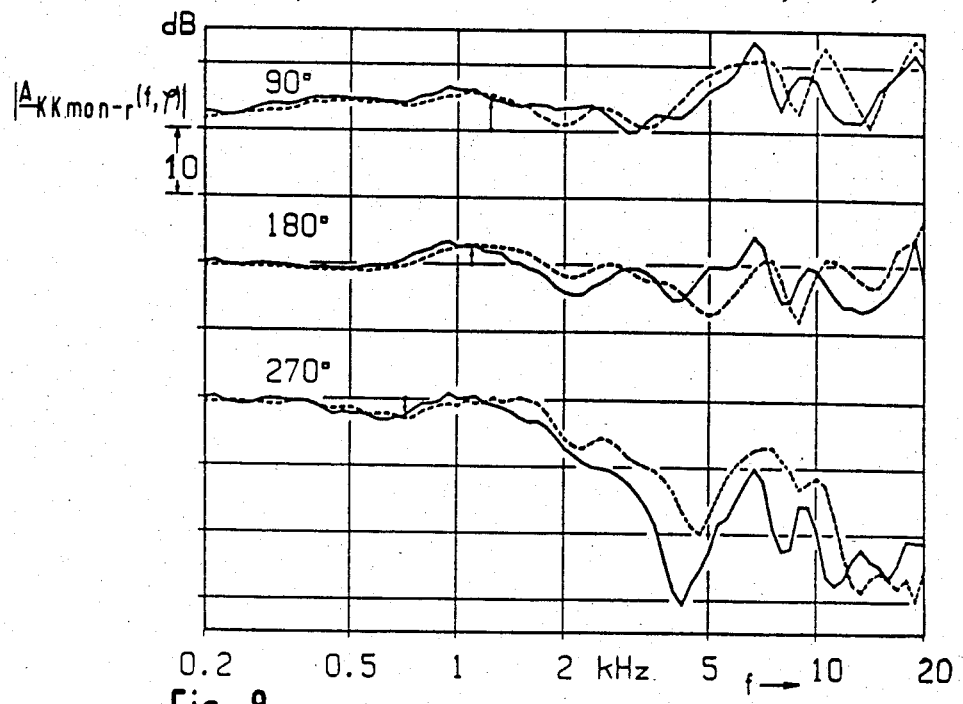
FIG. 8 shows the curves of monaural artificial-head transmission functions for different directions of sound incidence, as compared to average transmission functions of test persons (artificial head with exact imitation)
Figure 9:
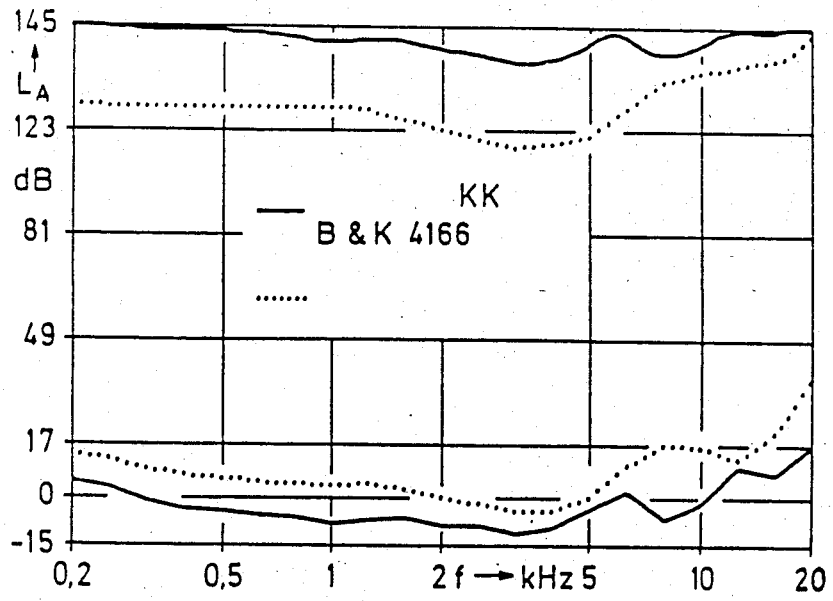
FIG. 9 shows the area of the so-called auditory sensation area of the artificial-head measuring system, compared with the human auditory sensation area.

FIG. 8 shows, for different specified directions of incidence, the monaural transmission functions of the calibratable artificial-head measuring system of the invention (shown in full lines) and, by way of comparison, the same functions of an artificial had with exact imitation of a test person (average test person); the conformity which is absolutely amazing for acoustical measuring results, and also the so-called auditory sensation area of the free-field equalized artificial head, as indicated in FIG. 9, by comparison with the human auditory sensation area, demonstrate the extensive conformity.

Finally, the curves shown in the diagram of FIG. 12 permit comparisons between the directional characteristic for different directions of incidence of sound and for the case of diffuse-field exposure, the curves a being related to the calibratable artificial-head measuring system of the invention, the curves b to an artificial-head measuring system with exact imitation of the head and the auricles, and the curves c being related to an average test person.

Consequently, the invention permits, by evaluating the acoustically relevant directional parameters of test persons and by mathematical determination and also simplification on the mathematical model, to provide—for example for standardization purposes—a fully calibratable artificial-head measuring system exhibiting an exactly defined simplified outer geometry, and this without any restriction of the directional reproduction when the artificial-head microphone signals are transmitted via free-field equalized headsets—a factor which is of decisive importance. Therefore, such a system is the first one that can be used in acoustic measuring techniques as a measuring, control and monitoring instrument supplying objective measuring results and permitting comparisons, while being equally suited for use as studio microphone for language and music in the broadcasting field.

All the features described and shown in the specification; the following claims and the drawing may be essential to the invention either alone or in any combination thereof.

I claim:

1. In an artificial-head acoustic measuring system comprising: a construction including portions configured to appear as human shoulders, head and ears on both sides of the head with auditory canals and microphones disposed in the auditory canals, wherein at least the head portion comprises partial bodies corresponding to mean data of test persons with respect to dimensions and relative positions, the partial bodies comprising regular geometric bodies calibrated with respect to sound reflexion, diffraction and resonance behavior to define a reproducible artificial-head transmission function related to the outer geometric configuration of the construction.

2. The artificial-head measuring system according to claim 1, wherein the shoulders portion comprises a flattened pyramid and an intermediate cylinder imitating a neck and wherein the head portion is configured as in ellipsoid.

3. The artificial-head measuring system according to claim 1, wherein the head portion comprises a lower partial body composed of a cylinder cut in the longitudinal direction, a middle partial body composed of an oval disk, and an upper partial body composed of two quarters of a sphere at the front and the rear with half a circular disk disposed therebetween.

4. The artificial-head measuring system according to claim 1, wherein each ear portion comprises an auricle formed by a cylinder with at least one recess having a bottom ending in the auditory canal terminated by an auditory canal orifice.

5. The artificial-head measuring system according to claim 4, wherein the cylinder forming the auricle is cut along a line following a secant and exhibits a slope of between 10° and 20°, rising from the front to the rear corresponding to the bottom to the top of the ear.

6. The artificial-head measuring system according to claim 1, wherein each auditory canal lies in a plane forming a reference point for the microphone and which is spaced from the front of the head by portion about 12 cm and from the bottom at about 10 cm.

7. The artificial-head measuring system according to claim 1, further comprising an impedance transformer connected to each microphone and followed by an equalizing network behaving inversely proportional to the artificial-head transmission function.

8. The artificial-head measuring system according to claim 7, wherein each reference plane is located at a distance of 16 cm above the corresponding end of the shoulder portion.

* * * * *